United States Patent [19]

Stog et al.

[11] Patent Number: 4,647,343

[45] **Date of Patent: * Mar. 3, 1987**

[54] SELF SEALING COKE OVEN DOOR OF LIGHTWEIGHT CONSTRUCTION

[75] Inventors: Wilhelm Stog; Jochen Stog, both of Waltrop, Fed. Rep. of Germany

[73] Assignee: WSW Planungs - GmbH, Waltrop, Fed. Rep. of Germany

[ * ] Notice: The portion of the term of this patent subsequent to Mar. 3, 2004 has been disclaimed.

[21] Appl. No.: 690,697

[22] Filed: Jan. 11, 1985

Related U.S. Application Data

[63] Continuation-in-part of Ser. No. 606,509, May 3, 1984.

[51] Int. Cl.[4] ..... C10B 25/00

[52] U.S. Cl. ..... 202/248; 110/173 R; 202/242

[58] Field of Search ..... 202/242, 245, 247, 248; 49/395; 220/314; 126/197; 110/173 R

[56] References Cited

U.S. PATENT DOCUMENTS

| | | | |
|---|---|---|---|
| 1,827,329 | 10/1931 | Otto . | |
| 2,234,575 | 3/1941 | Otto et al. | 202/248 |
| 4,400,240 | 8/1983 | Abendroth | 202/248 |
| 4,414,072 | 11/1983 | Breidenbach et al. | 202/248 |
| 4,422,902 | 12/1983 | Breidenbach et al. | 201/14 |
| 4,502,922 | 3/1985 | Stewen | 202/248 |
| 4,532,010 | 8/1985 | Dürslen et al. | 202/248 |

*Primary Examiner*—Jan Silbaugh
*Assistant Examiner*—Jennifer Cabaniss
*Attorney, Agent, or Firm*—Joseph J. O'Keefe

[57] ABSTRACT

A lightweight self-sealing flexible door for closing the end of a horizontal coke oven, which door comprises an outer assembly that includes a thin flexible plate and an inner plate assembly that extends into the oven and is supported by the outer assembly. Self adjusting pressure-distributing means associated with the exterior of the flexible plate continuously exert pressure at a plurality of spaced locations adjacent the outer periphery of the flexible plate to cause it to freely flex and urge sealing means adjacent the inner periphery of the flexible plate to substantially sealingly engage the surface of the frame of the oven as the frame is caused to warp and distort by the thermal cycling that occurs during operation of the coke oven. Latching devices hold the door in position against the oven frame and apply pressure upon the pressure-distributing means.

14 Claims, 6 Drawing Figures

SELF SEALING COKE OVEN DOOR OF LIGHTWEIGHT CONSTRUCTION

CROSS REFERENCES TO RELATED APPLICATION

This application is a continuation-in-part of copending application Ser. No. 606,509, filed May 3, 1984, entitled "Coke Oven Door of Lightweight Construction".

BACKGROUND OF THE INVENTION

This invention pertains to a lightweight door for a horizontal-chamber coke oven. The door has an outer assembly comprising a flexible, thin-walled sealing plate whose perimeter, which carries a sealing edge, is held against the oven frame by means of a flexible pressure distribution frame system to which pressure is applied by the door locking bars, and a lightweight door inner assembly comprising a coking plate that extends into the oven chamber. The coking plate is installed on the inner side of the sealing plate at a distance from it.

The coke oven doors that have been almost exclusively used thus far consist of a heavy casting that can weigh up to 5 tons and more. Such coke oven doors, which as a rule are equipped on the inner side with a ceramic plug approximately 16 inches, i.e. 40.6 centimeters, deep, may weigh between about 750–800 kilograms per meter, are difficult to handle, and require large and complicated machines to handle them. Furthermore, such doors are normally equipped with edge seals that, sooner or later, are unable to bridge the gaps that are created between the seals and the oven door frames or jambs, due to the thermal cycling that occurs during coke oven operation. These gaps permit emissions to escape from the ovens. Such a door is shown in U.S. Pat. No. 4,261,797, Kelly.

In July 1975 Battelle Columbus Laboratories published Report No. EPA-650/2-75-064 that described the results of a project undertaken for the National Environmental Research Center to analyze various known methods for sealing coke oven doors then in use. The report, entitled "Study of Concepts For Minimizing Emissions From Coke-Oven Door Seals", stated that the fundamental cause of visible emissions from coke oven seals is "+++the continuing thermal warpage and distorting of the cast-iron, oven-mounted jambs. While there are also design and warpage problems in existing door mounted seals, the degree of warpage on many jambs is in excess of the limits that some existing seals have been designed to handle." Unfortunately, the report offered no answers for the coke oven door seal problems.

Subsequently, there have been granted a number of patents directed to coke oven doors having improved designs for dealing with door sealing problems; see U.S. Pat. No. 4,145,258, Masamitsu, and U.S. Pat. No. 4,293,389, Clement. Also there are a number of patents directed to lightweight coke oven doors, see U.S. Pat. No. 4,119,496, Campana, and West German Patent No. 31 38 406.4. The latter patent describes a lightweight coke oven door that is easy to handle and one that can be positioned more accurately in front of a coke oven. The door body itself is connected with the chamber frame or pressed against it at more than two points. The known door consists of a sealing plate, which represents the actual door body and has knife edges at its periphery, which knife edges are pressed against the chamber frame by means of pressure elements, whereby these pressure elements bear against a continuous sealing frame made from a U-channel or from a similar shape and against the locking bars distributed over the height. In order to insure a uniform distribution of the bearing forces, six or more such locking bars are provided. Such a coke oven door is light in weight and highly flexible, because the door body, as it is described, consists of only a thin-walled sealing plate. Therefore it easily fits to the existing shape of the oven frame. As is known, owing to the temperature effect, the oven frame and the door warp away from their positions, whereby leaks can occur, since the knife edge cannot be continuously pressed sufficiently tightly against the oven frame during the thermal cycling of the ovens. As stated, this is not the case with the known flexible doors having the sealing plate as the door body. The flexibility of the one-piece door body is further increased, and thereby its weight is reduced, by eliminating the ceramic plug on the inner side and instead providing a coking plate supported by spacers at a distance from the door body. It has been found that after long use, owing to the accumulation of dirt or other deleterious effects, the knife edge is no longer pressed uniformly by the pressure element. This pressure element, preferably an inflatable tube, must also be protected against relatively high temperatures and thus it represents a weak point of the entire door. Also, installation of locking bars over the height of the coke oven door is frequently complicated, particularly when existing coke ovens are to be retrofitted with the described door. It is of a further disadvantage that, owing to the use of the sealing frame, which resists bending and runs along the periphery of the door and which bears against the pressure element, such doors have an element that reduces flexibility and also increases the door weight.

Accordingly, it is an object of the invention to provide a flexible coke oven door that insures a sure and reliable fit of the door sealing plate to the oven frame even at high temperatures and after long service.

A further object of the invention is to provide a self-sealing lightweight flexible coke oven door that is compatible with existing door handling and oven working machinery and capable of being retrofitted to existing and future coke ovens of all oven heights and design.

Another object is to provide a self-adjusting lightweight flexible coke oven door that maintains the door sealing edge in contact with the surface of the door jamb as the jamb is caused to warp and distort by the thermal cycling that occurs during both short and extended periods of coke oven operation.

SUMMARY OF THE INVENTION

The purpose is achieved according to the invention by combining a lightweight door inner assembly with a thin flexible sealing plate that is held against a coke oven frame by a self-adjusting flexible pressure-distributing frame system. The pressure-distributing frame system is installed with respect to the sealing plate in such a manner that it continuously acts without manual adjustment, on the sealing plate at points distributed at preselected distances over the periphery of the sealing plate.

Such coke oven doors are surprisingly light, weighing only about 250–300 kilograms per meter. The light weight is attributable to the very thin sealing plate, which is between about 2 to 8 millimeters thick, that is equivalent to the door body, and the door inner assembly that comprises a thermally conductive metal plate, i.e. coking plate, and supports. The coking plate serves, among other purposes, as a separator. Surprisingly, however, the entire door is so flexible that it is able to continuously fit the shape of the oven frame over its entire height during oven operations. The sealing edge engages tightly the entire oven frame, and the sealing edge on the sealing plate is able to insure tight sealing of the interior of the oven against the atmosphere over the entire height of the door. However, the flexibility of the entire door body offers not only the advantage of a continuous fit of the door body against a more or less warped oven frame, but also makes it possible to compress or penetrate the dirt on the oven frame, because the sealing plate or the sealing edge can be held with a great force against the oven frame. This great force is produced by means of suitable devices and applied at many points of the door by means of the pressure-distributing frame system.

According to a practical design of the invention, the pressure-distributing frame system consists of pressure-distributing elements that fit into one another and act on one another on both longitudinal edges of the sealing plate and on the top and bottom horizontal edges. These pressure-distributing elements insure as uniform as possible pressure transfer and flexing of short portions of the sealing plate as is required to conform the plate to any deformation of the oven frame. Furthermore, such a pressure-distributing frame system can be designed so that only a small weight increase of the entire system is achieved together with purposeful application or transmission of the pressure and with advantageous flexibility. Such a pressure-distributing frame system is very flexible in the direction of the oven frame, whereas it stiffens automatically during positioning of the coke oven door and when pressed.

In order to insure sufficient flexibility without overly increasing the size, it is proposed according to the invention to construct the pressure-distributing frame system in separate parts and to install them in conjunction with both sides of each locking bar. Thus, in the case of the usual coke oven door with two locking bars, four pressure-distributing frames are used. The frames are usually of the same design and are interchangeable. Furthermore, by means of properly constructed pressure-distributing frames, it is possible to apply the necessary force on the sealing plate and associated sealing edge advantageously over short distances. Then each pressure-distributing frame is advantageously equipped with four pressure-distributing links, which each act with two pads on the sealing plate. The links connect with the locking bar via two connecting levers and the distributing arms. Since the pressure-distributing arms, links, and connecting levers fit into one another the result is a unit that is not very high, and it acts at eight points on the sealing plate, so that, in the case of an approximately 6 m high door, the sealing plate and its associated sealing edge are pressed against the oven frame at 32 points around the circumference, as viewed over the height and on both ends. This results, as described previously, in continuous pressing of the flexible sealing plate against the more or less deformed oven frame or jamb.

The continuous pressure is produced in a simple manner and on pressure-distributing frames on both longitudinal sides of a sealing plate, or transmitted to these frames, in that, according to the invention, the pressure-distributing frames associated with a locking bar are connected to one another by means of a bridge plate whose distance from the locking bar can be varied by an adjusting mechanism. Conveniently, this adjusting mechanism can be a spindle or a spring that can be operated in a simple manner by the door lifting machine. The spindles or springs of both locking bars are actuated simultaneously, whereby simultaneous pressing upon the sealing plate is insured at preselected points.

In order to fix or secure the pressure-distributing frames on the sealing plate, the pads of the pressure-distributing links associated with the upper end of the sealing plate are joined to the sealing plate. The pressure-distributing frames associated with the lower locking bar have the pads of the pressure-distributing links associated with the lower end of the sealing plate joined to the sealing plate or in their middle in the area of the latches, but only at one point and loosely fitting. It may be appropriate to add several slide guides on the sealing plate, which slide guides can be constructed so that they contribute to the fixing or securing of the pressure-distributing frame system. In this manner, it is effectively and simply insured that the individual link systems are always placed a the preselected points and thus transmit the pressure at these points to the sealing edge through the sealing plate.

Experience shows that leaks are most likely to occur at the upper and lower ends of a coke oven door. This is due to the fact that the door frames usually buckle near the middle, and therefore the coke oven door and the sealing edge must undergo and accept the largest deflection at the door ends. These problems, in the manner described, do not occur with the new lightweight door because the sealing plate, which is equivalent to a door body, and the pressure-distributing frame system are very flexible. In order to apply by means of this frame system the various forces necessary at various points, the invention provides that elements of a pressure-distributing frame are of different lengths. Owing to the different lengths, it is possible, for example, to apply more pressure at the ends of the sealing plate than at the center. For this purpose, it is appropriate to vary the length of the pressure-distributing links so that link length increases from the ends to the center of the sealing plate. This results in the greatest pressures being applied at the upper and lower ends of the sealing plate.

To protect the sealing plate and to prevent distortion or similar damage, it is appropriate to insulate the sealing plate by means of an insulating layer toward the sealing edge as well as toward the distributor frame or the pads.

A design, according to which an insulating mat is provided on the inner and the outer faces of the sealing plate, also serves to protect the door body. Other doors known thus far also feature an insulating mat on the inner face. The primary purpose of the mat has been to insure that the gas flowing upward between the mat and the coking plate does not cool in the direction of this inner face. The insulating mat on the outer face now protects the mechanisms installed on the outer face and results in approximately the same temperatures o the inner and outer faces of the sealing plate, so that the sealing plate retains its shape over the entire height. The insulating mat can be installed in a particularly advantageous manner when the sealing plate is dished so that it protrudes into the door opening, and the insulating mat is placed in the resulting depression. The bending somewhat stiffens the thin-walled sealing plate, which is advantageous for handling of the door.

The invention is distinguished particularly by the fact that the service life of a coke oven door can be increased owing to appropriate and continuous application of pressures on the sealing plate and the smaller loads on the pressure elements. The high flexibility of the entire door is thereby increased, so that close contact of the sealing plate with respect to the door frame over the entire height of the door is provided. Without significantly increasing the height of the apparatus installed on the sealing plate, the pressure-distributing frame systems are installed so that they insure the desired fit of the sealing plate to the contour of the oven frame over the entire height. In the case of the design in which the pressure is applied in the middle by means of spindles or similar apparatus, it is possible to reuse the existing equipment when the doors are retrofitted to the ovens of batteries already in operation. The door body that is flexible over its entire area makes it possible to fit the entire door to the contour of the oven frame and thus insures a completely uniform sealing of the coke oven against the atmosphere. Even the critical upper and lower ends are secured, since the pressures are increased at these ends by more closely spaced pads of the pressure-distributing links.

BRIEF DESCRIPTION OF THE DRAWINGS

Further details and advantages of the subject of the invention follow from the description of the appropriate drawings, which show examples of preferred designs with the necessary details.

DESCRIPTION OF THE PREFERRED EMBODIMENT

Figure 1:
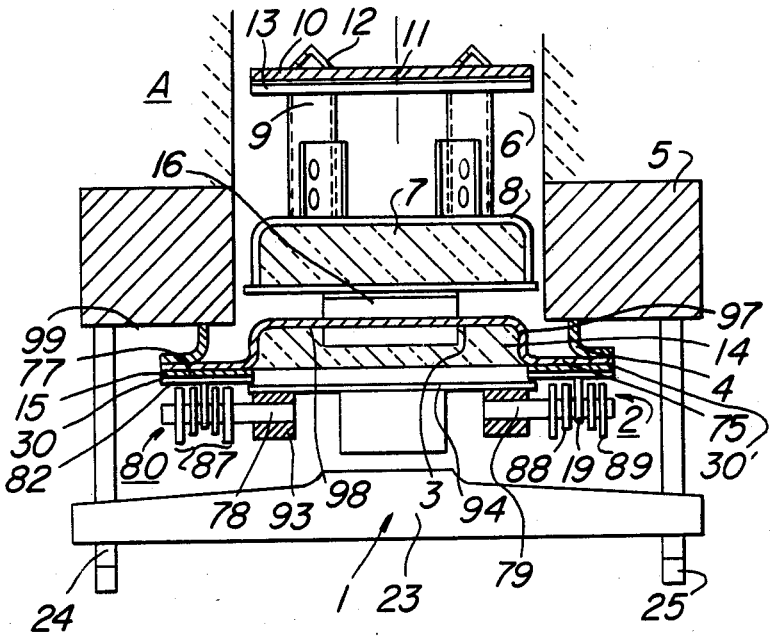
FIG. 1 shows schematically a transverse section through a coke oven door with a pressure-distributing frame system.

FIG. 1 shows a lightweight-construction coke oven door 1 closing oven opening 6 of coke oven A. The door body 2 of the flexible coke oven door 1 consists only of a thin-walled and flexible sealing plate 3. The thin-walled sealing plate 3 is slightly deformed or dished in its central portion and flat at its sides and ends to accept the knife edge 4 that extends along the inner periphery of plate 3. The knife edge is pressed against the sealing surface 99 of oven frame 5 by means of pressure elements or adjusting apparatus in order to seal oven opening 6 of the interior of the oven against the atmosphere.

An insulating mat 7 in a protecting housing 8 is spaced from the inner face 97 of the sealing plate 3. The mat protects the thin-walled sealing plate 3 and also insures that the gas flowing upward in the space between the insulating mat 7 and the overlapping coking plates 10 and 13, supported by spacers 9, contains sufficient heat or that the gas transfers the heat only to the coking plates 10 and 13. Spacers 9 are positioned over the height of the door and are connected with the protective housing 8 or with the plate that carries the housing. These spacers simultaneously support, as shown, the coking plates 10 and 13. The coking plates 10, 13 overlap one another, whereby screws 11 serve as a connection. Reinforcing angles 12 are installed on the oven side faces of the coking plates 10, 13, i.e. the faces exposed to the interior of the oven.

Angle-shaped knife edge 4 is installed on the oven or inner face 97 of the sealing plate 3, adjacent its inner periphery 75. As shown in FIGS. 1, 4, 5 and 6, a thin pressure-distributor element 15, in the shape of a narrow frame, is attached to the outer face 98 of sealing plate 3, adjacent its outer periphery 77. A plate covering the insulating mat 14, as shown in FiG. 1, can be attached, if desired, to the distributor element 15. It is also possible to design the distributor element 15 so that it also serves to cover the insulating mat 14.

Figure 2:
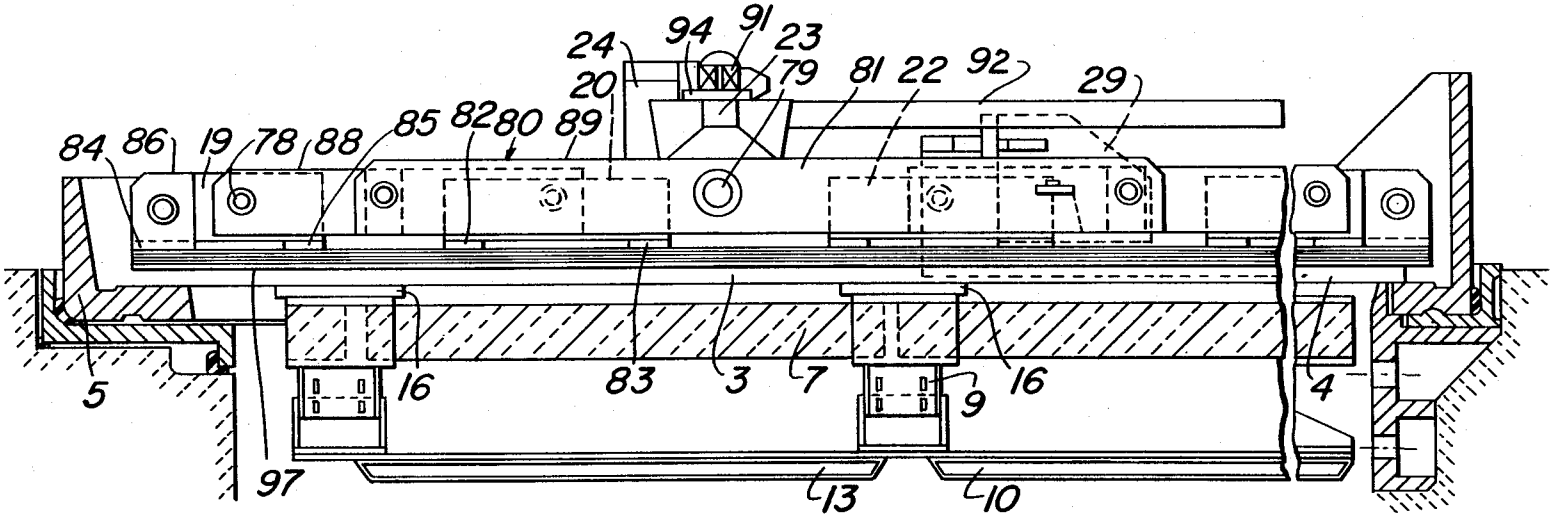
FIG. 2 shows a longitudinal section through a coke oven door with a pressure-distributing frame system.
Figure 3:
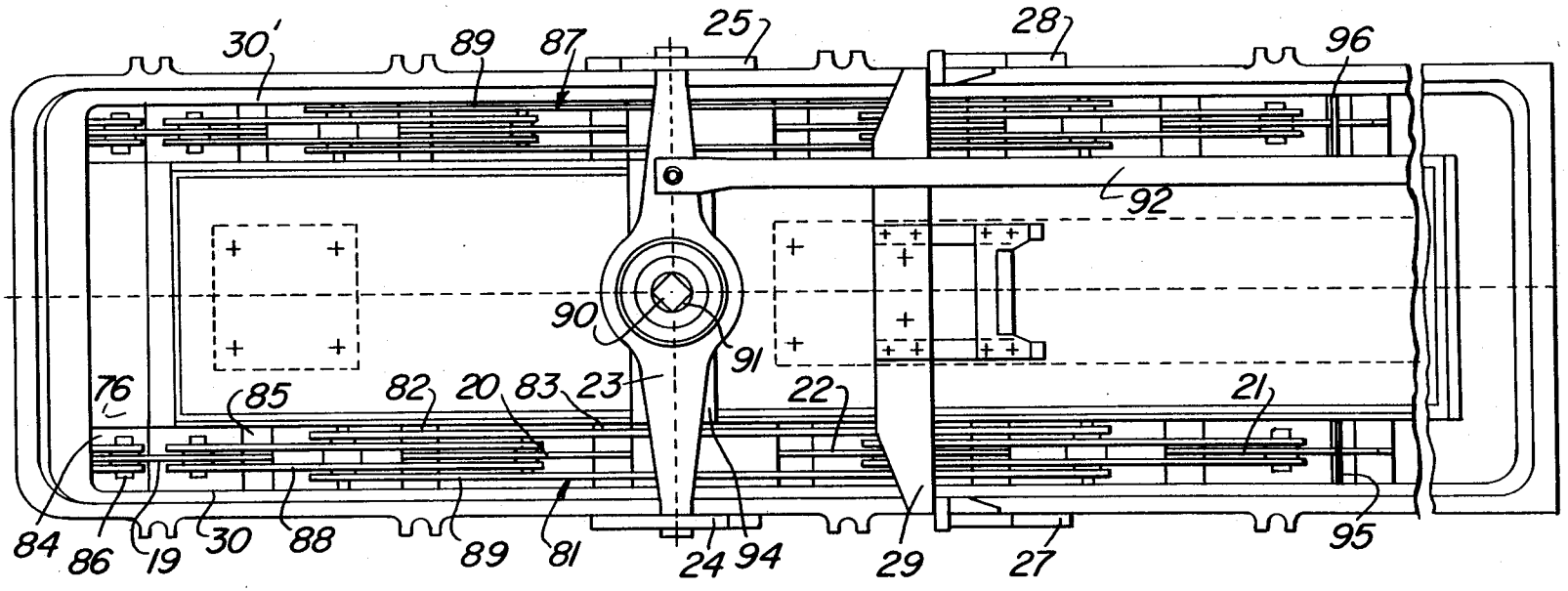
FIG. 3 shows a plan view of the coke oven door according to FIG. 1 and FIG. 2.

In the design example shown in FIG. 1, a pressure-distributing frame 81 of a pressure-distributing system 80 acts directly on the sealing plate 3, adjacent its outer periphery 77. This pressure-distributing frame 81, which subsequently will be described in more detail, is supported by a suitable locking bar 23. Pressure-distributing links 19, 20, as shown in FIG. 2 and FIG. 3, are connected by means of stay bolt 78 and other elements with the bridge element 94 and its bolt mount 93. This bridge part 94 can be moved in the direction of the door or in the opposite direction by means of a spindle (not shown in FIG. 1) that serves as an adjusting unit. Necessary pressure is thereby applied on the pressure-distributing frame 81 and thus on the sealing plate 3. The locking bar 23 lies in the locking hooks 24 and 25 and bears against them.

As FIG. 1 shows, the sealing plate 3 is protected by insulating mats 7 and 14 on the inner face 97 and outer face 98, respectively. The insulating mat 14 is installed in the dished portion or indentation of the sealing plate 3, which indentation is made by bending the sealing plate at several appropriate points. This mat 14 protects the external apparatus of the coke oven door and insures even heating of the sealing plate 3.

As shown in FIG. 3, the sealing plate 3 is continuously loaded on both sides adjacent the longitudinal edges 30 and 30′ by means of the pressure-distributing frames 81 and 87, installed there. For this purpose, as FIGS. 2 and 3 show, the pressure-distributing links 19, 20, 21, and 22, are constructed with pads, for example, pads 82 and 83 on link 20 and pads 84 and 85 on link 19. The pressure-distributing links 19, 20, 21, and 22 act on sealing plate 3, through these pads. They are supported from the bracket 86 and further appropriately constructed pressure-distributing elements of the pressure-distributing frames 81 and 87, which is shown in FIG. 3. The pressure-distributing elements act on connecting lever 88 and distributing arm 89. All parts are flexibly interconnected, so that the desired flexibility of the entire pressure-distribution frame system is insured.

FIG. 2 shows a section and FIG. 3 a plan view of the coke oven door according to FIG. 1, whereby the square 91 is clearly shown, through which the spindle, which serves as an adjusting unit 90, acts on the bridge element 94 and thereby insures that this element bears against the locking bar 23. Numeral 24 denotes a locking hook within which one end of the locking bar 23 is positioned. The effective fitting of the individual parts of the pressure-distributing frames 81 or 87 into one another is clearly seen in FIG. 2 and in FIG. 3. The movement of locking bar 23 at the upper end of door 1 is transferred to the other locking bar, not shown, at the lower end of door 1 by means of connecting bar 92.

As best seen in FIG. 2, the part of the pressure-distributing frame 81 associated with the upper end 76, of sealing plate 3, that is, the uppermost pad 84 is attached, preferably by welding, to the pressure-distributor element 15, which in turn is bolted (not shown) through the periphery 77 of sealing plate 3 to knife edge 4. Thereby the entire pressure-distributing frame 81 is always maintained in the same position, regardless of how often the coke oven door frame 1 is placed in front of the coke oven or removed from it. This purpose is also served by the slide guides 95, 96, shown in FIG. 3, which are located at the lower ends of pressure-distributing frames 81, 87, respectively, which act upon the upper end of sealing plate 3. The pressure-distributing frames, not shown, that act upon the lower end of sealing plate 3 are mounted in a similar fashion, except that the lowermost pads are attached to distributor element 15 and sealing plate 3 and the slide guides are located at the upper ends of the lower pressure-distributing frames.

FIGS. 2 and 3 also show that the individual pads 82, 83 or 84, 85 are installed at different distances from one another. The shortest pressure-distributing link 19 is installed in conjunction with the upper edge 76 and a similar link to the lower edge, not shown, of sealing plate 3, whereas toward the center of plate 3 the pressure-distributing links become longer and the distance between the pads becomes progressively greater, for example the distance between pads 82 and 83 of link 20 is greater than the distance between pads 84 and 85 of link 19.

As best seen in FIG. 1, the coking plate 10 held by spacers 9 is supported from the inner face 97 of the sealing plate 3. The spacers 9 are made of two parts and are equipped with a series of corresponding holes, so that the distance between the coking plates 10, 13 and the sealing plate 3 or the insulating mat 7 can be varied as needed.

Door pocket and support element 29 is adapted to receive the hook of the door extracting and positioning machine, which places the door in position on door supports 27 and 28, as shown in FIG. 3. The machine rests the support element 29 on supports 27 and 28 and then fastens the door in position by rotating locking bar 23 into engagement with the locking hooks 24 and 25. The machine also rotates adjusting unit 90 to apply pressure upon bridge element 94, pressure-distributing frames 81 and 87, and their associated elements, and as shown in FIG. 1 distribution element 15 which acts, upon the outer periphery 77 of sealing plate 3 to urge knife edge 4 against sealing surface 99 of door frame 5.

Figure 4:
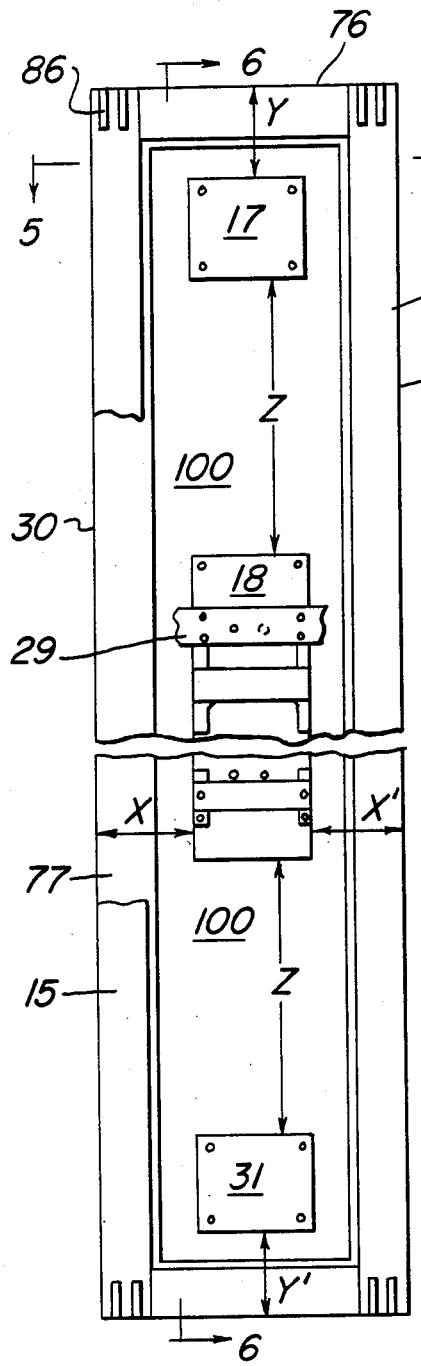
FIG. 4 shows a plan view of the door sealing plate showing in greater detail the elements of the door that are in direct contact with the sealing plate.
Figure 6:
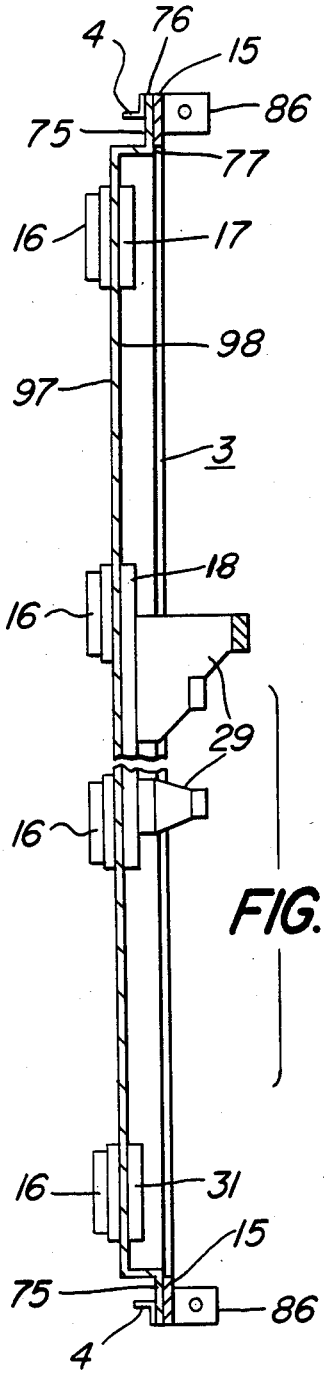
FIG. 6 shows a longitudinal section through the sealing plate and associated elements along the line 6—6 of FIG. 4.
Figure 5:
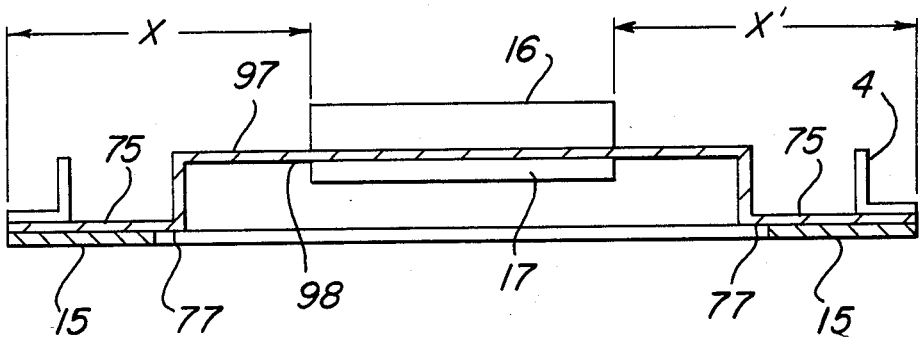
FIG. 5 shows schematically an enlarged top view of the sealing plate and associated elements along the lines 5—5 of FIG. 4.

Further details of the flexible lightweight self-sealing coke oven door of this invention are shown in FIGS. 4, 5 and 6. On doors for tall ovens, for example ovens having a height of greater than 4 meters, the very thin cross-section of sealing plate 3 results in an extremely flexible door that sometimes creates problems in supporting the weight of the inner door assembly, i.e. coking plates 10, 13. To avoid possible problems associated with very thin sealing plates, the door of this invention may be reinforced in selected areas. As shown in FIGS. 1, 5 and 6, on the inner face 97 of sealing plate 3, at spaced intervals extending longitudinally of the center area of face 97, are plate inner brackets 16, which extend inwardly of oven chamber 6. As shown in FIGS. 4 and 6, on the outer face 98 of plate 3, spaced from the upper edge 76 of plate 3, is plate upper outer bracket 17. A similar bracket, is located at the lower end of the door on its outer face 98, i.e. plate lower outer bracket 31. Also on the outer face 98 of plate 3 extending longitudinally of the center area is elongated center outer bracket 18. The upper inner bracket 16 and the upper outer bracket 17 are connected opposite one another on opposite sides of plate 3. A similar condition exists with respect to the inner and outer brackets at the lower end of the door. The inner brackets 16 in the center area of the sealing plate inner face 97 connect with elongated center outer bracket 18 on the outer face 98 of plate 3. Mounted on the outer face of center outer bracket 18, spaced from its upper and lower ends, are door pocket and support elements 29. The purpose of upper outer bracket 17, lower outer bracket, 31, and elongated center outer bracket 18 is to provide strength to those areas of the door to which other elements are fastened, e.g. inner brackets 16 and door pocket and support elements 29, and to provide the door with rigidity through a narrow portion of the door. The thin door would not possess reasonable strength and rigidity if the thin sealing plate 3 was not reinforced, particularly if the door was used on a high oven. However, these brackets contact only a minor portion of the total area of the inner and outer faces of plate 3, so they do not interfere with the ability of sealing plate 3 to flex and self-adjust to the contour of sealing surface 99 of door frame 5. To be more specific the brackets that contact the outer face of plate 3 impact upon less than about 25% of the area of the outer face 3. For example, with respect to a door of a 4 meter high oven the outer face brackets contact only about 17% of the area of the outer face.

The purpose and function of distribution element 15, which also adds strength and rigidity to the very thin sealing plate 13, is more clearly shown in FIGS. 4, 5 and 6. Distribution element 15 extends around the entire outer face 98, i.e. periphery 77, of sealing plate 3, on the opposite face of plate 3 from knife edge 4. As shown in FIGS. 2 and 3 the forces exerted upon the pads, e.g. 82, 83, 84 and 85, and their counterparts, of the pressure-distributing system 80 act upon small areas on the outer surface of distribution element 15. These pressures are then transmitted through element 15 and are applied by element 15 over a greater area upon sealing plate outer periphery 77.

By virtue of the design of sealing plate 3 and the elements that contact it, the plate may be described as having (A) a peripheral portion that has been described in terms of inner peripheral face 75 and outer peripheral face 77; (B) reinforced central portions that have been described in terms of plate inner brackets 16, upper outer bracket 17, lower outer bracket, 31, and center outer bracket 18; and (C) an intermediate portion that includes the area between the peripheral portion and the central portions. For purposes of illustration the intermediate portion has been identified in FIG. 4 with the number 100.

In the above described embodiment, for a door about 4 meters high and 0.63 meters wide, the thin flexible sealing plate 3 has a thickness of only 2 mm and is formed of a heat resisting stainless steel, such as type 304 or type 316, that will resist corrosion from chloride compounds released from some coals during the coking cycle. Plate upper outer bracket 17 is 22 cm×25 cm×1.5 cm; center outer bracket 18 is 25 cm×213 cm×1.5 cm; inner brackets 16 are 22 cm×25 cm×1.5 cm and distribution element 15 is 10 cm wide×1 cm thick.

With the above description of the flexible light weight coke oven door of this invention, the unique favorable features of the door can be explained.

When the door of this invention is moved into position before a coke oven opening, a hook of the door positioning machine is engaged with door pocket and support elements 29, which is rested upon door supports 27 and 28, as shown in FIG. 3. Locking bar 23 is rotated into position to engage locking hooks 24 and 25, as shown in FIGS. 2 and 3, and adjusting unit 90 is activated to exert pressure upon bridge element 94 and through the pressure-distributing frames 81 and 87 on the upper section of the door and corresponing frames, not shown, of the lower end of the door. The pressure is exerted through the pressure-distributing system to the distributor element 15. Element 15 as shown in FIGS. 1, 4, 5 and 6, bears upon the outer periphery 77 of sealing plate 3, applying pressure upon knife edge 4 on the inner periphery 75, to urge the knife edge into contact with the sealing surface 99 of oven frame 5 along the longitudinal edges 30 and 30'. The door may also be equipped with pressure distributing elements at its upper and lower ends. The knife edge portions at the upper and lower ends of the door are moved by such pressure distributing elements in conjunction with the movement of the knife edge portions along the longitudinal edges of the door.

When door frame 5 and its sealing surface 99 are straight, a relatively light pressure from the door extracting and positioning machine will, through door pressure-distributing system 80, urge knife edge 4 into contact with oven frame sealing surface 99, and sealing plate 3 remains relatively straight, i.e. undeformed. However, when, after a period of time, oven door frame 5 warps and distorts and its sealing surface 99 is no longer straight, a greater pressure may be exerted by the door extracting and positioning machine upon the door when it is placed in position against the door frame, which then exerts greater pressure on pressure-distributing system 80. Pressure-distributing system 80, through its several flexible pressure-distributing frames, e.g. 81 and 87, will for example, continuously exert pressure upon the periphery of sealing plate 3, at spaced intervals thereof. In response to such pressure the peripheral and intermediate portions of thin sealing plate 3 will freely flex and permit the peripheral portion of plate 3 and associated knife edge 4 to conform to the contour of sealing surface 99 of warped oven frame 5. As is best shown in FIGS. 4 and 5, sealing plate 3 can freely flex transversely through distances X and X' along the plate sides, longitudinally through distance Y, at the top and a similar distance Y' at the bottom, and longitudinally through distance Z between upper outer bracket 17 and the top of center outer bracket 18 and a similar distance Z' between the bottom of center outer bracket 18 and lower outer bracket 31.

As used herein, the term "freely flex" refers to the ability of thin sealing plate 3 to flex relatively unencumbered, as best shown in FIGS. 4, 5 and 6, through its peripheral portion 77 intermediate portion 100 in response to the pressures exerted upon spaced intervals of the sealing plate's outer periphery 77 by means of the pressure-distributing system 80. The term "self adjust" refers to the ability of the pressure-distributing frames, e.g. 81 and 87 as shown in FIGS. 2 and 3, through their interconnected and pivoted pressure-distributing links, connecting levers and distributing arms, to automatically readjust position and continuously exert pressure upon the peripheral portion of sealing plate 3 and maintain its associated knife edge 4 in contact, as shown in FIG. 1, with the oven door frame sealing surface 99, even as the contour of surface 99 changes in response to thermal cycling that occurs during both short and long term periods of operation of a coke oven.

As can be seen, the door of this invention, self adjusts to various oven frame surface conditions. The door of this invention does not have any of the various types of numerous adjusting devices of prior art doors that periodically require manual adjustment to compensate, if possible, for large gaps that may occur between the door's knife edge and the sealing surface of a deformed door frame. Furthermore, the door of this invention does not have any heavy reinforcing plate to make the door itself rigid and/or have a rigid system to support numerous adjusting devices, such as spring loaded elements, for knife edges.

The invention has been described with reference to the preferred embodiment. Those skilled in the art will recognize that with a thicker sealing plate 3, for example 8 mm thick, and for a small oven height, the reinforcing elements, i.e. pressure distributor element 15, plate inner brackets 16, outer bracket 17 and center outer bracket 18 may be reduced in thickness or even eliminated. Also, particularly on doors for high ovens, a third pressure-distribution system, with fewer elements and pressure pads, may be used. Sealing plate 3, which was described as made of stainless steel, may also be made of normal carbon steel, unless the coking coal contains large amounts of chlorides. Obviously modifications and alterations may be made by others upon their review of this specification and it is my intention to include such modifications and alterations insofar as they come within the scope of the appended claims.

We claim:

1. A lightweight self-sealing flexible door for closing the end of a coke oven having an opening defined by an oven frame, with a sealing surface thereon, said door comprising:

(A) a door inner assembly designed and constructued to extend into said oven;

(B) a door outer assembly comprising:

(1) a flexible plate having:

(a) a inner face, (b) an outer face, (c) a first longitudinal edge, and (d) a second longitudinal edge;

(2) support means extending between said door inner assembly and said door outer assembly flexible plate;

(3) a first flexible self-adjusting pressure distributing means comprising a plurality of interconnected and pivoted;

(a) distributIng links, (b) connecting levers, and (c) distributing arms, said means designed and constructed to exert pressure at a plurality of spaced locations on the outer face of said flexible plate, adjacent the first longitudinal edge thereof;

(4) a second flexible self-adjusting pressure distributing means, comprising a plurality of interconnected and pivoted:
(a) distributing links,
(b) connecting levers, and
(c) distributing arms,
said means designed and constructed to exert pressure at a plurality of spaced locations on the outer face of said flexible plate, adjacent the second longitudinal edge thereof;

(5) pressure application means designed and constructed to apply pressure upon said first and second pressure distributing means whereby said pressure distributing means transmit pressure along the first and second longitudinal edges of the outer face of said flexible plate to cause at least a portion of said flexible plate to freely flex and urge the longitudinal edges of the inner face thereof to sealingly engage the sealing surface of said oven frame as said frame is caused to warp and distort by thermal cycling that occurs during periods of operation of the coke oven.

2. The lightweight self-sealing flexible door of claim 1 wherein the thin flexible plate of door outer assembly has a thickness of between about 2 to 8 millimeters.

3. The light weight self-sealing flexible door of claim 1 wherein the flexible plate of the door outer assembly is reinforced adjacent the first and second longitudinal edges of the outer face thereof by door outer assembly frame means to impart strength and rigidity to said door outer assembly.

4. The lightweight self-sealing flexible door of claim 1 wherein each of the outer and inner faces of the flexible plate fo the door outer assembly has a peripheral portion, an intermediate portion, and a central portion, said central portions of the outer and inner faces thereof being reinforced by bracket means to impart strength and rigidity to said flexible plate while permitting the peripheral and intermediate portions of said flexible plate to freely flex in response to pressure applied by said first and second distributing means along the first and second longitudinal edges of the outer faces of said flexible plate.

5. The lightweight self-sealing flexible door of claim 4 wherein said reinforcing plate bracket means on the central portions of the outer and inner faces of the flexible plate of the door outer assembly contact no more than between about 10% to 25% of the total area of each of said faces of said plate.

6. A lightweight self-adjusting, self-sealing flexible door for closing the end of a coke oven having an opening defined by an oven frame, with a sealing surface thereon and ajdacent door locking means, said door comprising:

(A) a door inner plate assembly designed and constructed to extend into said oven;

(B) a doot outer assembly comprising:
(1) a flexible plate having
(a) an inner face,
(b) an outer face,
(c) a first longitudinal edge, and
(d) a second longitudinal edge;
(2) support means extending between said door inner plate inner plate assembly and said inner face of said door outer assembly;
(3) sealing means associated with the inner face of said flexible plate, adjacent the first and second longitudinal edges thereof;
(4) a first flexible, self-adjusting pressure distributing means comprising a plurality of interconnected and and pivoted:
(a) distributing links,
(b) connecting levers, and
(c) distributing arms,
said means designed and constructed to exert pressure at a plurality of spaced locations on the outer face of said flexible plate, adjacent the first longitudinal edge thereof;
(5) a second flexible, self-adjusting pressure distributing means, comprising a plurality of interconnected and pivoted;
(a) distributing links,
(b) connecting levers, and
(c) distributing arms,
said means designed asnd constructed to exert pressure at a plurality of spaced locations on the outer face of said flexible plate, adjacent the second longitudinal edge thereof;
(6) latch mechanism and pressure application means designed and constructed to:
(a) engage said door locking means and hold said door in position against said oven frame, and
(b) continuously apply pressure upon said first and second pressure distributing means and therethrough to a plurality of spaced locations adjacent the first and second longitudinal edges of the outer face of said flexible plate, to cause at least a portion of said flexible plate to freely flex and to urge the sealing means adjacent the longitudinal edges of the inner face of said flexible plate to sealingly engage the sealing surface of said oven frame as said frame is caused to warp and distort by thermal cycling that occurs during periods of operation of the code oven.

7. The lightweight self-sealing flexible door of claim 6 wherein the flexible plate of said door outer assembly has a thickness of between about 2 to 8 millimeters.

8. The lightweight self-sealing flexible door of claim 7 wherein the door has a weight of about 250 to 300 kilograms per meter.

9. The lightweight self-sealing flexible door of claim 6 wherein the flexible plate of said door outer assembly is reinforced adjacent the first and second longitudinal edges of the outer face thereof by door outer assembly frame means to impart strength and rigidity to said door outer assembly.

10. The lightweight self-sealing flexible door of claim 6 wherein each of the outer and inner faces of the flexible plate of said door outer assembly has a peripheral portion, an intermediate portion and a central portion, said central portions of the outer and inner faces thereof being reinforced by bracket means to impart strength and rigidity to the flexible plate while permitting the peripheral and intermediate portions thereof to freely flex in response to pressure applied by said first and second pressure distributing means adjacent the first and second longitudinal edges of the outer face of the flexible plate.

11. The lightweight self-sealing flexible door of claim 6 wherein said reinforcing bracket means on the central portion of the outer and inner faces of the flexible plate of said door outer assembly contact no more than between about 10% to 25% of the total area of each of said faces of said plate.

12. A lightweight self-adjusting, self-sealing flexible door for closing the end of a coke oven having an opening defined by an oven frame, said door comprising:

(A) a door outer assembly comprising:

(1) a plate having:

(a) an outer face, (b) a first longitudinal edge, and (c) sa second longitudinal edge;

(2) first upper and first lower flexible, self-adjusting poressure distributing means, each comprising a plurality of interconnected and pivoted:

(a) distributing links, (b) connecting levers, and (c) distributing arms, each said means exerting pressure at a plurality of spaced locations on the outer face of said flexible plate, adjacent the first longitudinal edge thereof;

(3) second upper and second lower flexible self-adjusting pressure distributing means, each comprising a plurality of interconnected and pivoted:

(a) distributing links, (b) connecting levers, and (c) distributing arms, each said means exerting pressure at a plurality of spaced locations on the outer face of said flexigle plate, adjacent the second longitudinal edge thereof;

(4) first bridge means connecting said first upper and second upper pressure distributing means;

(5) second bridge means connecting said first lower and second lower pressure distributing means;

(6) first latch mechanism and pressure application means engaging said first bridge means; and (7) second latch mechanism and pressure application means engaging said second bridge means.

13. The lightweight self-addjusting, self-sealing flexible door of claim 12 wherein said door outer assembly plate has a thickness of between about 2 to 10 millimeters.

14. A lightwiehgt, self-adjusting, self-sealing flexible door for closing the end of a coke oven having an opening defined by an oven frame, with a sealing surface thereon and a plurality of adjacent door locking means, said door comprising:

(A) a door inner assembly;

(B) a door outer assembly comprising:

(1) a flexible plate having a thickness of between about 2 to 10 millimeters and (a) an inner face, (b) an outer face, (c) a first longitudinal edge, and (d) a second longitudinal edge;

(2) means connecting said inner door assembly to said door outer assembly;

(3) sealing means associated with the inner face of said flexible plate, adjacent the first and second longitudinal edge thereof;

(4) first upper and first lower flexible, self-adjusting pressure distributing means, each comprising a plurality of interconnected and pivoted:

(a) distributing links, (b) connecting levers, and (c) distributing arms, each said means exerting pressure at a plurality of spaced locations on the outer face of said flexible plate, adjacent the first longitudinal edge thereof;

(5) second upper and second lower flexible, self-adjusting pressure distributing means, each comprising a plurality of interconnected and pivoted:

(a) distributing links, (b) connecting levers, and (c) distributing arms, each said means exerting pressure at a plurality of spaced locations on the outer face of said flexible plate, adjacent the second longitudinal edge thereof;

(6) first bridge means connecting said first upper and second upper pressure distributing means;

(7) second bridge means connecting said first lower and second lower pressure distributing means;

(8) first latch mechanism and pressure application means designed and constructed to engage a first pair of said door locking means and exert pressure on said first bridge means and therethrough to said first and second upper pressure distributing means;

(9) second latch mechanism and pressure application means designed and constructed to engage a second pair of said door locking means and exert pressure on said second bridge means and therethrough to said first and second upper pressure distributing means;

whereby the pressure exerted by said pressure distributing means cause the flexible plate of said door outer assembly to freely flex and to urge the sealing means adjacent the longitudinal edges of the inner face of the flexible plate to sealingly engage the sealing surface of said oven frame as said frame is caused to warp and distort by thermal cycling that occurs during periods of operation of the coke oven.

* * * * *

UNITED STATES PATENT AND TRADEMARK OFFICE

CERTIFICATE OF CORRECTION

PATENT NO. : 4,647,343

DATED : March 3, 1987

INVENTOR(S) : Wilhelm Stog, et al.

It is certified that error appears in the above-identified patent and that said Letters Patent is hereby corrected as shown below:

In Column 4, line 63 of the Patent, change "o" to --on--.

Column 6, line 19 of the Patent, change "Fig." to --FIG.--.

In the claims:

In Claim 1, column 10, line 62 of the Patent, delete "distributIng" and substitute --distributing-- therefor.

In Claim 4, column 11, line 34 of the Patent, delete "fo" and substitute --of-- therefor.

In Claim 6, column 11, line 53 of the Patent, delete "ajdacent" and substitute --adjacent-- therefor.

In Claim 6, column 11, line 57 of the Patent, delete "doot" and substitute --door-- therefor.

In Claim 6, column 11, line 64 of the Patent, delete "inner plate".

In Claim 6, column 12, line 17 of the Patent, delete "asnd" and substitute --and-- therefor.

UNITED STATES PATENT AND TRADEMARK OFFICE

CERTIFICATE OF CORRECTION

PATENT NO. : 4,647,343

DATED : March 3, 1987

INVENTOR(S) : Wilhelm Stog, et al.

It is certified that error appears in the above-identified patent and that said Letters Patent is hereby corrected as shown below:

In Claim 12, column 13, line 8 of the Patent, delete "sa" and substitute --a-- therefor.

In Claim 12, column 13, line 10 of the Patent, delete, "poressure" and substitute --pressure-- therefor.

In Claim 12, column 13, line "26" of the Patent, delete "flexigle" and substitute --flexible-- therefor.

In Claim 14, column 13, line 41 of the Patent, delete "lightwiehgt" and substitute --lightweight-- therefor.

Signed and Sealed this

Twentieth Day of October, 1987

*Attest:*

DONALD J. QUIGG

*Attesting Officer*

*Commissioner of Patents and Trademarks*